US008166980B2

(12) United States Patent
Maruyama et al.

(10) Patent No.: US 8,166,980 B2
(45) Date of Patent: May 1, 2012

(54) WIG AND METHOD OF MAKING THE SAME

(75) Inventors: Shin-ichi Maruyama, Shinjuku-ku (JP); Takashi Sato, Shinjuku-ku (JP); Yasuhiro Kondo, Shinjuku-ku (JP)

(73) Assignee: Unihair Co., Ltd., Tokyo (JP)

( * ) Notice: Subject to any disclaimer, the term of this patent is extended or adjusted under 35 U.S.C. 154(b) by 420 days.

(21) Appl. No.: 12/445,572

(22) PCT Filed: Oct. 22, 2007

(86) PCT No.: PCT/JP2007/070577
§ 371 (c)(1),
(2), (4) Date: Apr. 14, 2009

(87) PCT Pub. No.: WO2008/050731
PCT Pub. Date: May 2, 2008

(65) Prior Publication Data

US 2009/0314306 A1 Dec. 24, 2009

(30) Foreign Application Priority Data

Oct. 25, 2006 (JP) ..... 2006-290558

(51) Int. Cl.
*A41G 3/00* (2006.01)

(52) U.S. Cl. ..... 132/53

(58) Field of Classification Search ..... 132/201, 132/53–56
See application file for complete search history.

(56) References Cited

U.S. PATENT DOCUMENTS 5,135,011 A * 8/1992 Motoori et al. ..... 132/54

FOREIGN PATENT DOCUMENTS

| | | | |
|---|---|---|---|
| JP | 05-009801 | A | 1/1993 |
| JP | 2545240 | B2 | 7/1996 |
| JP | 2549553 | B2 | 8/1996 |
| JP | 10-168630 | A | 6/1998 |
| JP | 11-107024 | A | 4/1999 |
| JP | 2001-159018 | A | 6/2001 |
| JP | 2003-306821 | A | 10/2003 |
| JP | 2005-325508 | A | 11/2005 |
| WO | 2007-046431 | A1 | 4/2007 |

OTHER PUBLICATIONS

International Search Report (ISR) for PCT/JP2007/070577, Date: 2007.
PCT/ISA/237, IB338, and IB373 of PCT/JP2007/070577, Date: 2007.

* cited by examiner

*Primary Examiner* — Rachel Steitz
(74) *Attorney, Agent, or Firm* — Chen Yoshimura LLP

(57) ABSTRACT

In the wig 10 provided with a wig base 11 and hair materials 12 attached to the wig base, the wig base 11 is zoned in its front portion 11*a* to an artificial skin portion 110*a* from a virtual hairline of the wearer's forehead portion toward a top portion and to a net pattern 11*b* connected thereto, the artificial skin portion is made of a synthetic resin film integrated with a shape retention net, provided with a front edge region 111 of the pre-determined width from a front edge 11*a*' positioned on the wearer's virtual hairline toward inside and with a rear region 112 connected to the front edge region, and the front edge region 111 is bent to a sharper inclination than the wearer's corresponding head outline, giving a curved ridge line, resulting in an arc-shaped warp up prevention structure.

11 Claims, 13 Drawing Sheets

(A)

(B)

WIG AND METHOD OF MAKING THE SAME

TECHNICAL FIELD

This invention relates to a wig covering at least a part of the wig wearer's head from its frontal of the head toward back of the head, and a method of making the same.

BACKGROUND ART

A conventional wig for wearing on a thin haired head has a wig base comprising an artificial skin made of synthetic resin and a mesh-like net or their combination, and the wig base is formed accurately correspond to or similar appearance to the wearer's head shape, and then completed with such hair material as human or artificial hair attached thereto.

As one of the problems upon wearing such a wig, it is likely that a front edge of the wig is visible as a line at the wearer's frontal of head upon wearing the wig, resulting in exposure of the wig wearing to bystanders around. Therefore, several methods have been proposed recently to prevent wig exposure by making the border between the forehead skin and the wig hardly visible.

In order to solve the problem, a conventional wig is constituted, for example, as shown in FIG. 17. In FIG. 17, a wig 1 is comprised of a wig base 2 and a hair material, which is not shown, attached to the wig base 2, and the wig base 2 is also constituted with a front portion 2*a* and a net portion 2*b* connected to the front portion 2*a* to make up a rear region of the wig base 2.

The front portion 2*a* is made of a soft synthetic resin, for example, such as urethane resin, and formed as ultra thin, for example, of thickness about 0.08 to 0.12 mm. The net portion 2*b* is made as fine mesh, and integrally connected to the front portion 2*a* by sewing, bonding, or others at the connecting portion 2*c*. The hair material, which is not shown in the figure, is attached by known methods to the above-mentioned front portion 2*a* and the net portions 2*b*, respectively.

The wig base 2 comprising the front portion 2*a* and the net portions 2*b* is formed, as shown in FIG. 18, as so-called bowl shaped its whole corresponding to the wearer's head shape by using a male plaster mold 3 imitating the wearer's head shape, giving a curved shape swelling upward, and by cutting along a border line 3*a* forming a peripheral edge of the wig base. Thereby, upon wearing, the wig base 2 contacts closely to the wearer's head, especially the front edge 2*a*' of the front portion 2*a* contacts closely along the hairline of the upper end of the wearer's forehead portion, making wig wearing unexposed.

Patent Citation 1: Japanese Patent Number 2545240 and Patent Citation 2: Japanese Patent Number 2549553 disclose a wig provided with a shape retention member made of a shape memory alloy or plastics having a transformation temperature higher than that of the wig base upon wearing at the pre-determined position in the concave inner surface of the wig base. By this design, upon wig wearing, the wig base can fit to a head shape by curving and transforming the shape retention member to fit properly to the head shape. Further, if the shape retention member is transformed to a wavy shape or the like by repeated use, the memorized linear or curved shapes are restored by heating the shape retention member region of the wig base for the shape memory alloy or plastics constituting the shape retention member to be heated above transformation temperature. Thereby, there will be an effect, as same as a case where the shape retention member is exchanged for new one.

Patent Citation 3: Japanese Patent Publication Number 05-009801 also discloses a wig with a hair material attached thereto made of a shape memory alloy covering edges of the wig base, and the edges are not exposed when the hair material is curled up by the wind or others.

However, with the above-mentioned wig 1, warp up may be caused at the front edge including front edge 2*a*' of the front portion 2*a* on the wig base 2 by repeated wearing of the wig 1 by the wearer, and resulting in the curl up of the front edge of the wig base 2 upon wearing. In this case, contact with the wearer's head may deteriorate, and it causes poorer appearance of the wig and exposure of wig wearing. Also there may be wrinkles on overall front portion 2*a* of wig base 2. Especially, if the wrinkles were generated whole on near the front edge of the front portion 2*a*, contact with the wearer's head deteriorates in the same way of the above-mentioned situation, appearance of a wig is made poorer as well as wig wearing is exposed.

The wig, described in Japanese Patent Number 2545240 and Japanese Patent Number 2549553, retains properly the wig base shape by a shape retention member, but contact with the wearer's forehead is not necessarily improved, in case the front edge of the wig base is curled up or the like. Also, the wig described in Japanese Patent Publication Number 05-009801 uses a hair material made of shape memory alloy so that the wig base front edge is hardly visible when the wig base front edge is curled up, but the curl up of the wig base front edge itself is not prevented essentially.

Patent Citation 1: Japanese Patent Number 2545240

Patent Citation 2: Japanese Patent number 2549553

Patent Citation 3: Japanese Patent Publication Number H05-009801

The present invention was created with the above-mentioned aspects taken into consideration, and the first object of this invention is to provide a wig wherein curl up by repeated use is prevented at the wig base front edge of artificial skin.

Second object of the present invention is to provide a method of making the wig wherein curl up is prevented at the wig base front edge.

DISCLOSURE OF THE INVENTION

In order to achieve the above-mentioned first object, a wig of the present invention has a wig base and hair materials attached to the wig base, wherein the wig base is provided with an artificial skin portion at least in the front portion from the virtual hairline of the wearer's forehead portion toward a top portion, the artificial skin portion, which is made of a synthetic resin film integrated with a shape retention net, is provided with a front edge region of the pre-determined width from the front edge positioned on the wearer's virtual hairline toward inside and a rear region connected to the front edge region, and the front edge region is bent to form a sharper inclination than the wearer's corresponding head outline so as to have a structure to prevent warp up.

"The inclination" is defined as the degree representing a slope of the front edge of the front portion with respect to a horizontal line on the vertical cross section of the wig, and, in the present invention, the cross sectional shape of the front edge of the front portion includes not only linear but also curved shape. The shape wherein the front edge of the front portion has the sharper inclination than the wearer's head outline also includes a shape, as an example, wherein the front edge of the front portion is formed by curving with a larger curvature than the wearer's forehead outline.

"The structure to prevent the warping up" is shaped preferably arc-like to form a curved ridge line at a bent position between the front edge region of the front portion and the rear region connected thereto, and the front edge region is curved arc-like in the width direction.

The shape retention net integrated with the artificial skin portion of the front portion is preferably made of a non-elastic net.

The wig base includes the front portion constituted with the artificial skin portion and a top portion connected to the front portion, wherein the top portion is constituted with net pattern, and the rear region and the top portion excluding the front edge region of the front portion may be formed in a curved shape substantially corresponding to the wearer's head shape. The front edge of the artificial skin portion is preferably formed in a wavy shape, and is located at the position of the wearer's virtual hairline.

In the wig of the present invention, the front portion is preferably provided with an adhesive layer which is adhered unpeelably to the back side of the artificial skin portion with hair materials attached thereto for fixing needle stitch portions of the hair materials, and to be pressure-bonded repeelably to head skin. The repeelable function of the adhesive layer is realized after completion of gelation reaction of the adhesive layer.

The adhesive layer is preferably made of urethane gel, specifically two liquid mixture type urethane resin pressure-sensitive adhesive made of a main agent and a curative agent. The main agent is a polyol with a urethane resin as a main component and the curative agent is polyisocyanate as a main component.

In order to further achieve the above-mentioned second object, the present invention provides a method for manufacturing a wig having a wig base provided with an artificial skin portion located in a front portion from a virtual hairline of the wearer's forehead portion toward a top portion and hair materials attached to the wig base by using a male pattern of a head shape. The male pattern has a cutoff surface which is cut to the sharper inclination than the outline of the forehead portion from the position corresponding to the virtual hairline of the wearer's forehead portion toward the lower side. The present invention discloses a method for manufacturing the artificial skin portion by integrating the synthetic resin film with shape retention net, comprises fixing a shape retention net on the male pattern as to cover the cut off surface, coating a thermoplastic elastomer to the shape retention net, and drying it.

The second implementation of the present invention is a method for manufacturing a wig, which comprises a wig base provided with an artificial skin portion in a front portion together with a net type top portion connected to a rear edge of the front portion and hair materials to attach to the wig base, by using a male pattern of a head shape having a cutoff surface cut to the sharper inclination than the outline of the forehead portion from the position corresponding to the virtual hairline of the wearer's forehead portion toward the lower side, comprising;

First step: to obtain an artificial skin portion integrated with a shape retention net portion and provided with a warp up prevention structure by bending to the sharper inclination than the outline of the wearer's corresponding head portion the front edge region of the pre-determined width from the front edge positioned on the wearer's virtual hairline toward inside by, after fixing the shape retention net on the male pattern so as to cover the cutoff surface, coating a thermoplastic elastomer to the shape retention net and drying, Second step: to obtain a net pattern for the top portion by forming a pattern of the head shape to the net member, Third step: to overlap the artificial skin portion obtained in the first step on the upper or the lower surface of the net pattern obtained in the second step, and to connect the artificial skin portion and the net pattern on the pre-determined rear edge of the front portion, Fourth step: to, after connection, cut off the excess part of the artificial skin portion to be the front portion, and to obtain the wig base of the pre-determined shape by cutting off the excess part of the net pattern to be the top portion, and Fifth step: to attach hair materials to the wig base.

Advantageous Effects

According to the wig of the present invention, since the front portion of the wig base is made from the artificial skin material with a shape retention net as a base material, rigidity and shape retainability of an ultra thin front portion are enhanced by the shape retention net, and curl up of the front edge, stretch, generation of wrinkles, and others are prevented. Thereby, the wig base can be worn on the wearer's head in contact closely, especially in the region of the front portion where is the pre-determined distance toward the top portion from the wearer's hairline.

Also, the front portion of the wig base is zoned to a front edge region having the pre-determined width from the front edge to inside and a rear region connected to the front edge region. Since the front edge region is formed so as to have a sharper inclination than the outline of the wearer's forehead portion, it is worn with the front portion in the curved state as if biting into the wearer's forehead portion. Therefore, the front edge region of the front portion, especially the front edge corresponding to a hairline contacts closely and firmly to the upper edge of the forehead portion, as well as even if the front edge of the front portion is curled up a little by repeated use, because the curling up being from the curved state to inside, the front edge of the front portion does not warp up so much so that it floats up so much as not to fit to the wearer's head shape, and it comes into close contact firmly.

Thus, according to the present invention, since the front portion is formed with the ultra thin artificial skin material integrated with the shape retention net, and the front edge region is formed slightly curved toward the head portion with respect to the head shape, curl up, wrinkles, and stretch are not generated in the wig base, especially in its front portion, even by repeated use, so that it does not float up from the wearer's scalp. Consequently, since close contact of the wig base, especially of its front portion, with the wearer's scalp is maintained, appearance of the wig does not deteriorate, and use of the wig is not exposed.

By the method of manufacturing a wig in accordance with the present invention, if a ridge line of the border between the cutoff surface of the plaster pattern and the outline of a forehead portion contacting thereto is formed by cutting and rounding, the curvature radius on the ridge line is relatively large, and the curvature is relaxed in the front edge region of the front portion, so that close contact with the wearer's scalp is enhanced. This is because, by relaxing curvature, the front portion can be manufactured which is approximated to the wearer's head shape more closely. If the ridge line is cut by the width 2 to 5 mm, more preferably 3 mm, and curved, the close contact with the wearer's scalp is optimized.

EXPLANATION OF MARKS AND SYMBOLS

Figure 1:
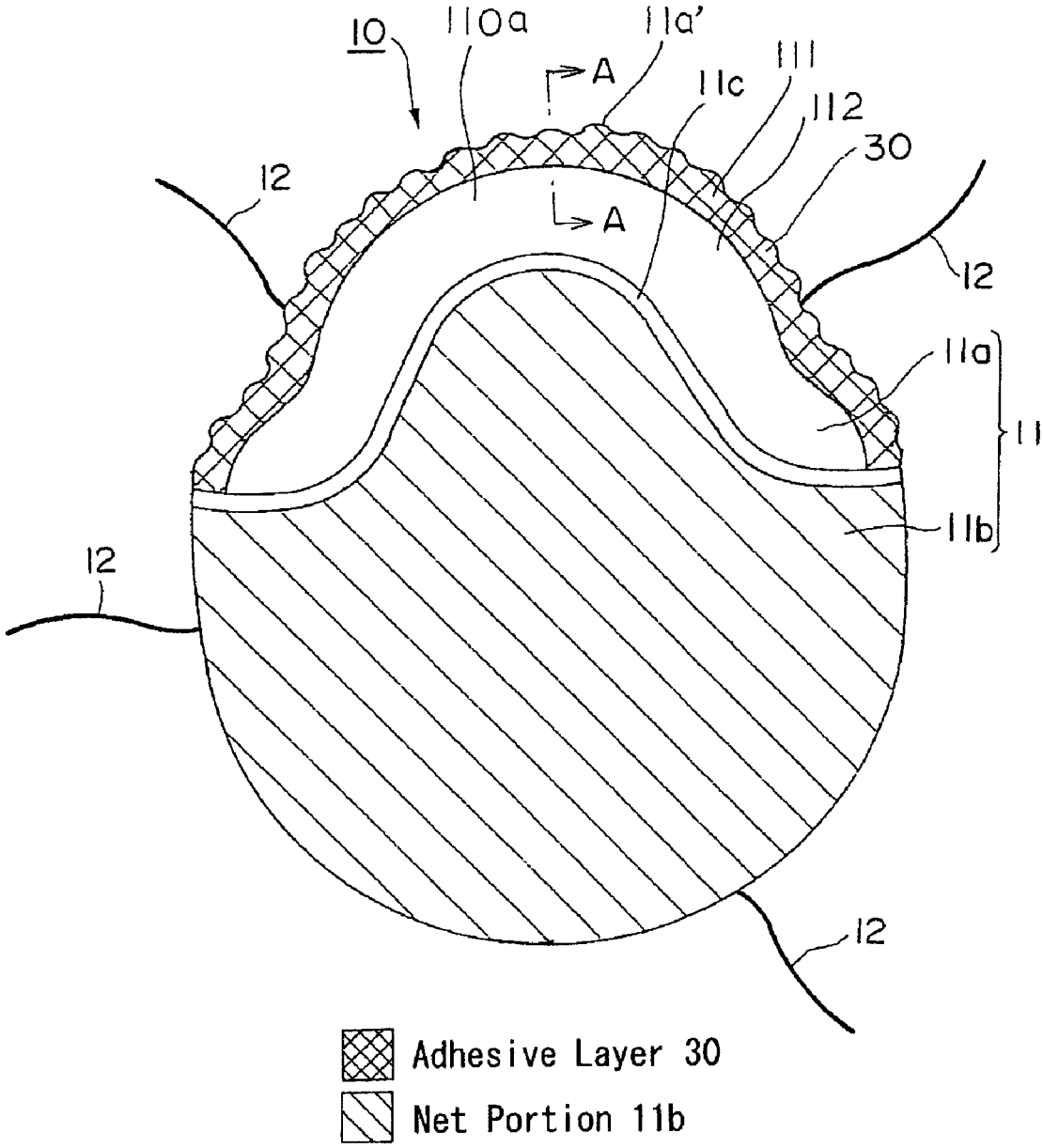
FIG. 1 is a plan view illustrating an back side of a makeup of one example of embodiment of a wig in accordance with a present invention.

10: Wig
11: Wig base
11*a*: Front portion
11*a*': Front Edge
11*b*: Net pattern
11*c*: Connecting portion
12: Hair material
12A: Needle foot portion
20: Male pattern
20*a*: Border line
21: Stage
22: Plaster pattern
22*a*: Cutoff surface
22*b*: Ridge line
23: Shape retention net
24*a*, 24*b*: Fixing needle
30: Adhesive layer
40: Peelable sheet
51, 61*a*, 51*b*: Top
52: Valley
110: Warp up prevention structure
110*a*: Artificial skin portion
111: Front edge region
112: Rear region

BEST MODES FOR CARRYING OUT THE INVENTION

Hereinafter, the present invention will be described in detail on the basis of the embodiments shown in drawings.

FIG. 1 is a view illustrating a wig 10 of an embodiment of the present invention, especially illustrating the back side of a wig 10. The wig 10 comprises a wig base 11, a plurality of hair materials 12 attached to the wig base 11, and clipping members, which is not shown, such as a stopper for a wig attached to the desired position in the back side of the wig base 11. In FIG. 1, only a few strands of hair materials 12 attached to the wig base 11 are drawn for simple explanation of the structure of the wig base 11, and most of the rest are omitted, but, in actuality, the hair materials 12 are densely attached protruding upward over the whole surface of the wig base 11.

Figure 2:
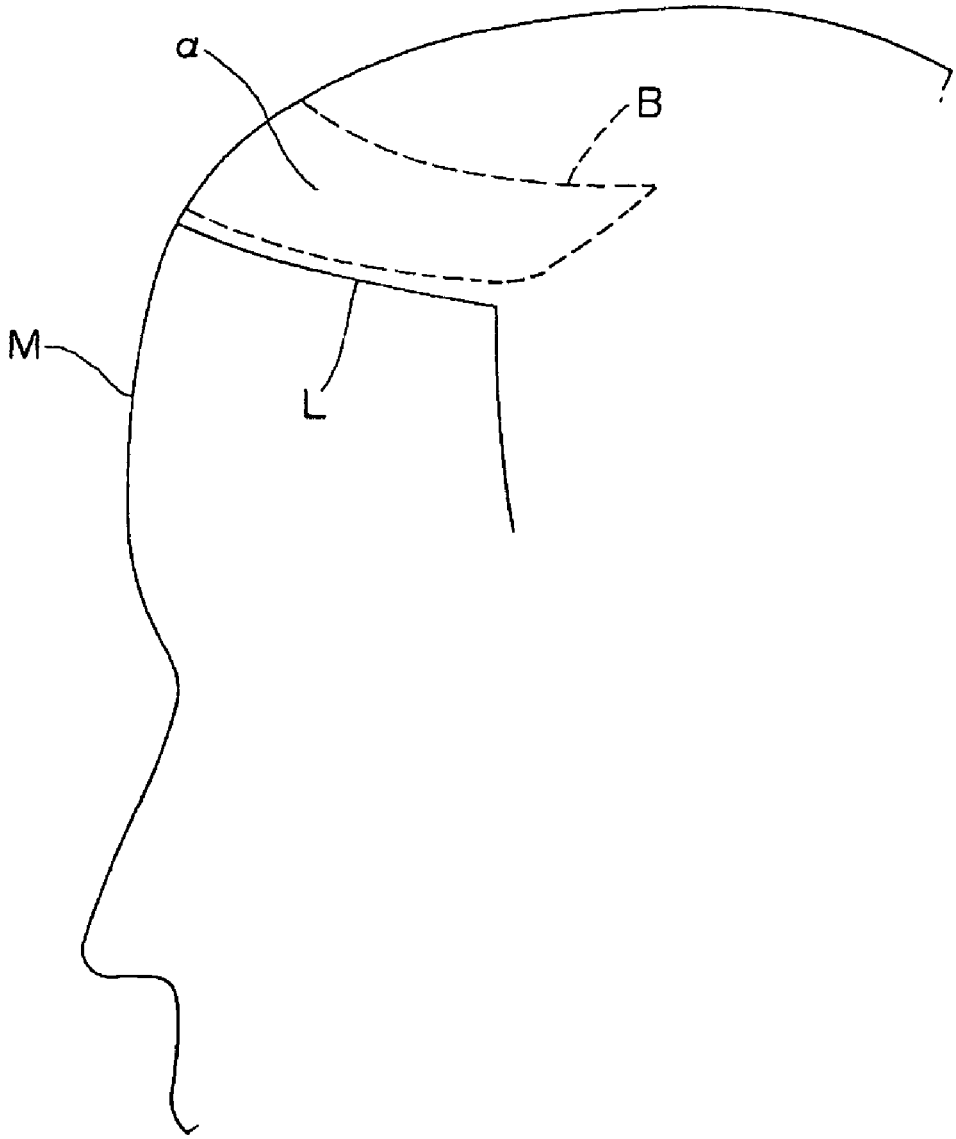
FIG. 2 is a view illustrating a makeup of the wig of FIG. 1.

The wig base 11 comprises a front portion 11*a* from a virtual hairline of the wearer's forehead portion toward a top portion, and a net pattern 11*b* connected to the front portion 11*a*, which forms a main part of the base. In the wig base 11, the outer shape of the front portion 11*a* is formed along the hairline L of the wearer's forehead portion. Explanation is made of the wig wearer's hairline L in the embodiments of the present invention. FIG. 2 is a diagrammatical side view of the wig wearer, and the hairline L is a border line dividing a forehead portion and a hair side, and positioned at the uppermost edge of the wearer's forehead portion M. The hairline L is crossing the forehead portion from the hair side corner portion of the forehead at both side portions. In this case that the hairs are lost in the wig wearer's frontal of the head, so that the hairline is not clear, such hair line L is assumed as, for example, the line assumedly existing above eyebrows by about 3 to 6 cm if hair existed naturally in the frontal of the head. The present invention defines this assumable hairline as virtual hairline L or hairline L.

The front portion 11*a* of the wig base 11 of the present invention corresponds to the frontal region of the head, which can be seen through hair when the wig wearer is seen in front. Its size is so selected as to correspond to the frontal region $\alpha$, for example, surrounded with dotted line B in FIG. 2 apart by the pre-determined distance, for example, about 2 to 5 cm from the wearer's virtual hairline L to the top portion side. The front portion 11*a* is zoned to a front edge region 111 of the pre-determined width from a front edge 11*a*' corresponding to the wearer's virtual hairline L toward inside and to a rear region 112 connected to the front edge region 111. The front edge region 111 is the front-most region of the width inside by about 1 to 5 mm from the front edge 11*a*' constituting the hairline L toward the top portion.

Figure 3:
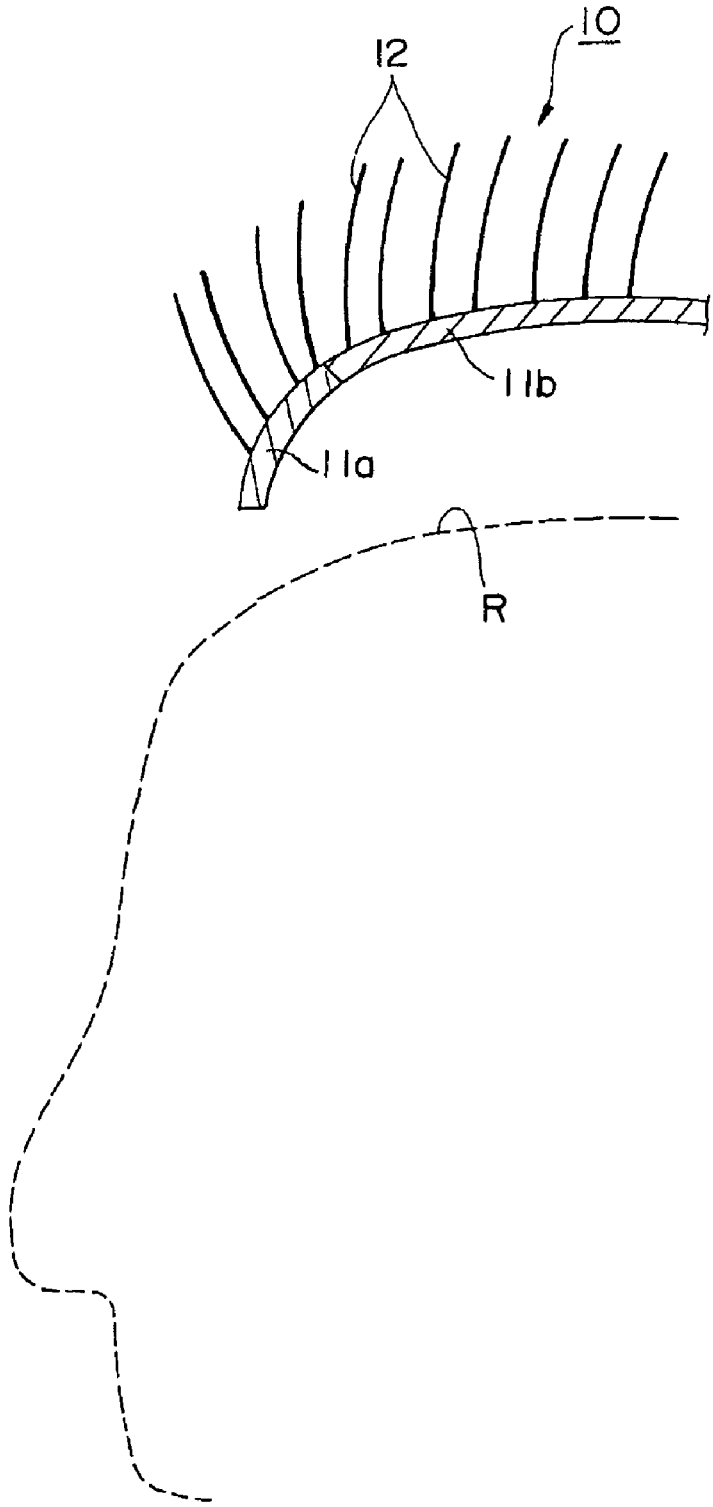
FIG. 3 is a partial side view illustrating the wig of FIG. 1.
Figure 4:
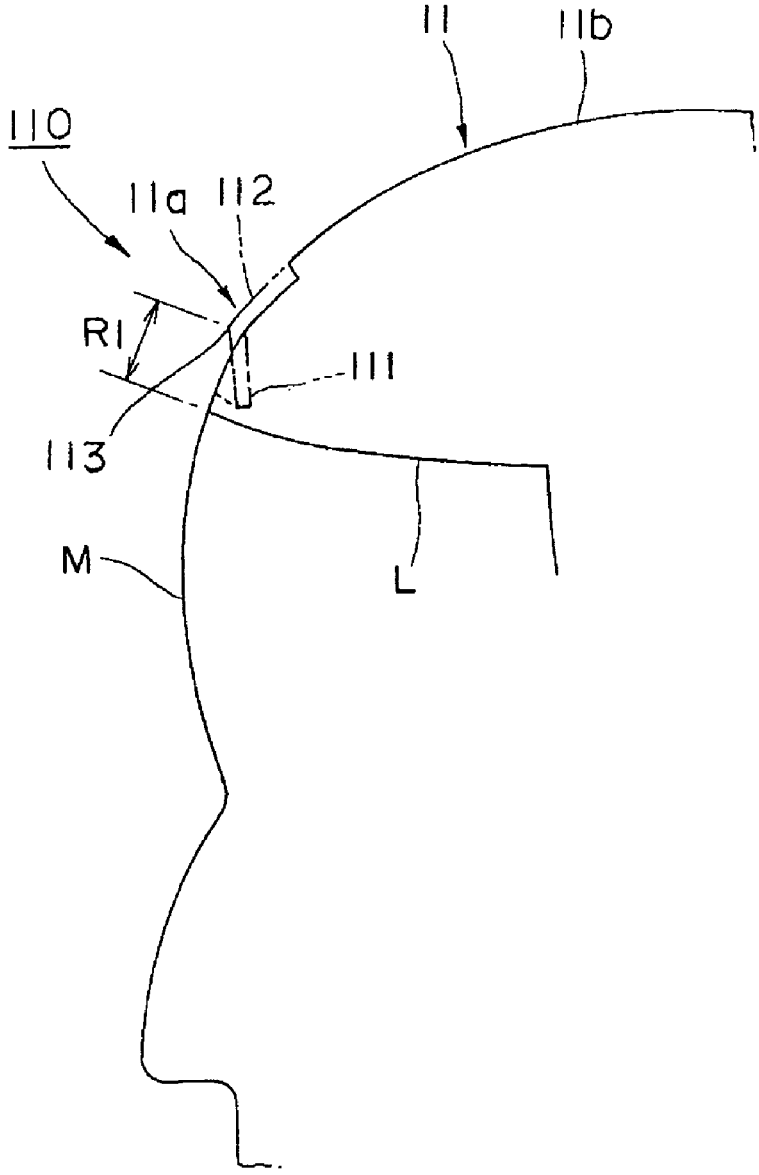
FIG. 4 is a view illustrating a makeup of the wig of FIG. 1.

Further, the wig 10 of the embodiment of the present invention is characterized in that the front edge region 111 of the front portion 11*a* is formed, as shown in FIG. 3, so as to have a sharper inclination than the outline R in the vertical direction of the wig wearer's forehead portion, that is, the vertical line curved from the head top side to the virtual hairline L. Specifically, as shown by a dotted line in FIG. 4, the front portion 11*a* of the wig base 11 is such that the front edge region 111, that is, the region of about 1 to 5 mm from the tip of the front portion to the rear region 112 is formed to have a sharper inclination than the wig wearer's head shape corresponding thereto, that is, the outline R1 of 1 to 5 mm from the hairline L to the head top portion, and constitutes a warp up prevention structure 110. With this warp up prevention structure 110, the front edge stretches and relaxes with the repeated wearing and taking off of a wig or with the strong wind, curl up can be prevented by the front edge region 111 being bent more sharply than the wearer's corresponding head outline. According to the present embodiment, the warp up prevention structure 110 is formed arc-like to provide a curved ridge line at the bent position 113 between the front edge region 111 and the rear region 112 connected thereto. Therefore, the front edge region 111 of the warp up prevention structure 110 is formed with its edges cut off in the width direction, that is, the vertical direction, by curving arc-like.

Figure 13:
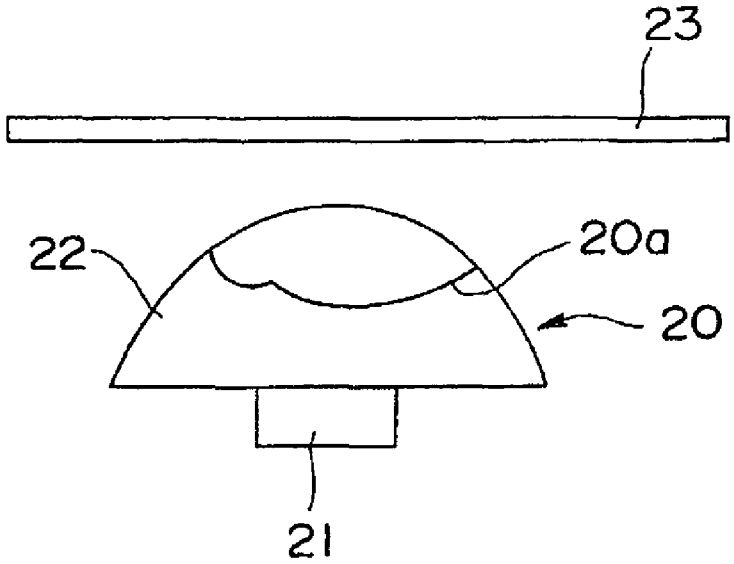
FIGS. 13 (A) and (B) are views sequentially showing manufacturing steps of artificial skin of the wig of FIG. 1.
Figure 13:
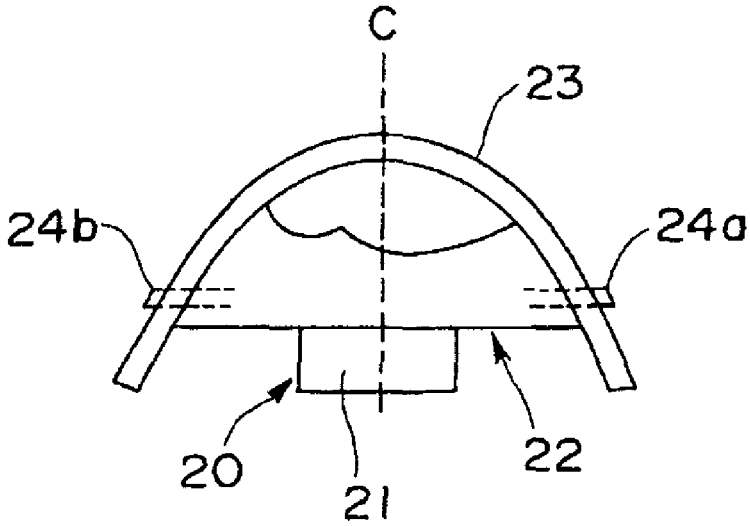

The front portion 11*a* is made of a soft synthetic resin film such as a urethane resin with a shape retention net buried therein with a shape retention net [See FIG. 13] as a base material, and is formed ultra thin, for example, about 0.08 mm to 0.12 mm thick. Threads which make up a shape retention net as a base material as having a diameter thinner than the thickness of the front portion 11*a* are used so as not to be exposed on the surface of the front portion 11*a*.

The shape retention net as made of a non-elastic synthetic resin is used. This is because if an elastic net is used as a base material, coating and drying of a thermoplastic elastomer to be an artificial skin on the net during the manufacturing process of the front portion 11*a* causes stretch and contraction of the net, resulting in distortion of the completed front portion shape. For the shape retention net, possessing the proper rigidity as to a base cloth is used. If rigidity is too low, the effect is weak for prevention of curl up or wrinkles of the front portion 11*a*, and if too high, softness is spoiled of the front portion 11*a*. Further the mesh of the shape retention net, its shape and its number as used for a net of the conventional wig base are used. Namely, nets of ordinary mesh can be used so far as they satisfy the above-mentioned conditions of a thread diameter or rigidity, and do not have the shape easily exposed upon wig wearing.

Specifically, a net [thread diameter 43μ m, mesh 105 [strands/inch], bending rigidity 0.0126 [gf $cm^2$/cm]] made of a polyamide synthetic fiber such as nylon [Registered Trademark] is used for a shape retention net. On the other hand, since, for example, the net [thread diameter 50μ m] of commercial nylon [Registered Trademark] for stockings is highly elastic and has low shape stability. If this is used as the shape retention net, stretch and contraction are generated in the front portion 11*a*, as well as since the bending rigidity is comparatively as low as 0.0012 [gf $cm^2$/cm], it is inappropriate for prevention of curl up or wrinkles of the front portion 11*a*. The net [thread diameter 50μ m] of polyester has markedly high bending rigidity of 0.0896 [gf $cm^2$/cm], so that if this is used to make up the front portion 11*a* as a shape retention net, it is not preferable because the front portion 11*a* becomes hard, and softness and flexibility are lost, resulting in less close contact with a head.

Figure 5:
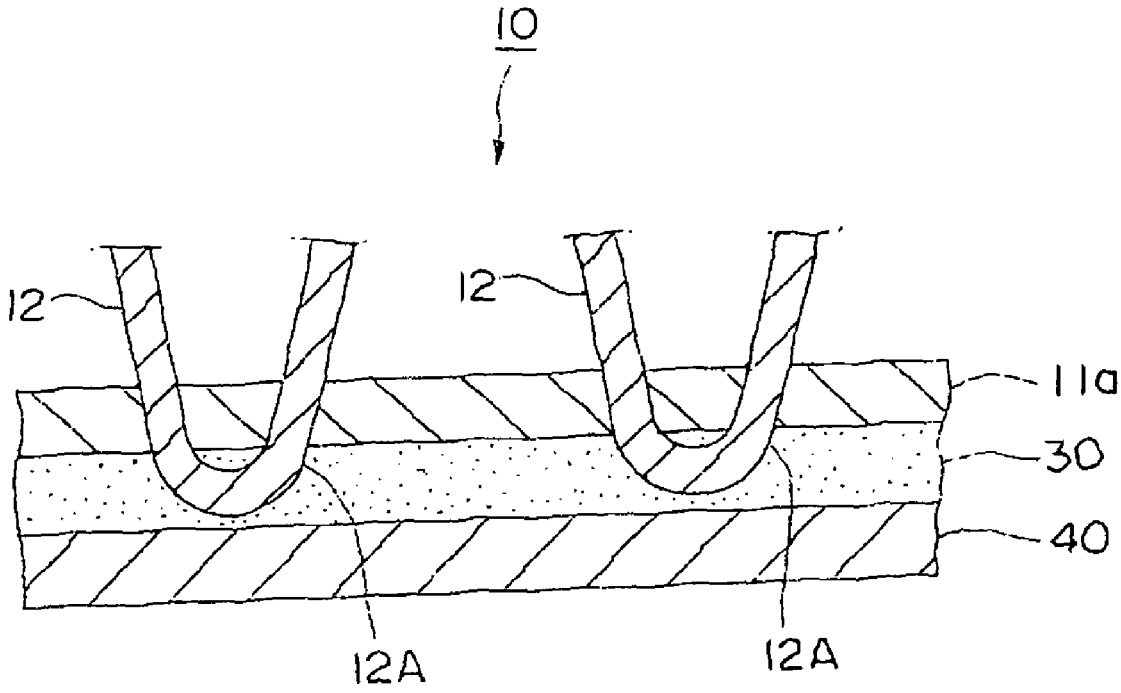
FIG. 5 is a cross sectional view along line A-A of FIG. 1.

Further, in the wig 10 of the present embodiment, as shown in FIG. 1, an adhesive layer 30 as a single layer for the wig [hereinafter, to be properly referred to as adhesive layer] is coated on the back side of the front portion 11*a* by the predetermined width along a front edge region 111 or a front edge region 111 and a rear edge region 112 of the front portion 11*a*. FIG. 5 is a cross sectional view along line A-A of FIG. 1, which is a cross sectional view diagrammatically illustrating the makeup of the front edge region of the front portion 11*a* of the embodiment of the present invention.

As shown in FIG. 5, hair materials 12 are planted from the surface side of the front portion 11*a* through to the back side, and again pulled out to the surface side of the front portion 11*a* to form V letter or U letter shape. These spot-like or linear hair materials penetrating to the back side of the front portion 11*a* and exposed on the back side are defined as a needle stitch portion 12A. Above-mentioned planting method is usually referred to as V-planting.

The adhesive layer 30 as a single layer is adhered unpeelably to the back side of the front portion 11*a*, and has a specific property capable of repeelably pressure-bonding to the wig wearer's head. Also, the adhesive layer 30 has a hair fixing function to fix the needle stitch portions 12A of the hair materials 12 planted through to the back side of the front portion 11*a*. Thus, the front portion 11*a* of the wig 10 of the present embodiment is made up as two layer structure comprising the front portion 11*a* and an adhesive layer 30 as a single layer adhered to its back side. Meanwhile, on the back side of the front portion 11*a* where the adhesive layer 30 is not coated, a urethane solution for hair fixing is coated, thereby the needle stitch portion 12A of the hair material 12 is fixed to the front portion 11*a*.

The adhesive layer 30 of the embodiment of the present invention is adhered to the back side of the front portion 11*a* by chemical bonding by gelation reaction of the adhesive solution coated on the back side of the front portion 11*a*. As for the needle stitch portion 12A of the hair material 12, when the adhesive layer 30 is adhered to the front portion 11*a*, the needle stitch portion 12A is sandwiched between the front portion 11*a* and the adhesive layer 30, the needle stitch portion 12A of the hair material 12 is simultaneously fixed on the back side of the front portion 11*a*. In another way, the adhesive layer 30 as shown in FIG. 5, a peelable sheet 40 such as a vinyl chloride sheet may be provided which can be easily peeled off by the wearer's hand.

The side of the adhesive layer 30 contacting the head can be repeelably pressure-bonded to the head. The repeelable function of the adhesive layer 30 to the head is realized after gelation reaction of the adhesive. Therefore, the adhesive layer 30 after completion of gelation reaction can adhere to the head at room temperature, for a short time, and by applying only slight force. Namely, it has a property of pressure-bondable pressure-sensitive adhesive layer [so-called tackifying layer]. Further, the adhesive layer 30 after completion of gelation reaction is capable of repeated bonding to a scalp by wiping off its surface with a trace amount of water or organic solvent. This capability of repeated bonding is referred to in the present invention as repeelable function, or simply peelable function.

Explanation is next made of the material of the adhesive layer for the wig 30 of the present invention.

As the adhesives for the wig to be used to form the adhesive layer 30, urethane resins, acrylic resins, and rubbers are listed as a rough classification. The adhesives for the wig of urethane resins have good adhesiveness to the artificial skin portion constituting the front portion for fixing needle stitch portions 12A of hair materials 12 to the front portion 11*a*, and have a property capable of unpeelable adhesion between the adhesive layer 30 and the front portion 11*a*. Its repeelable property is also good for bonding to the head, and it has low skin irritancy. Therefore, adhesives for the wig of urethane resins can be used preferably as the adhesives for the wig to form the adhesive layer 30 of the present invention.

On the other hand, adhesives of acrylic resins have good tackiness, but their repeelable property is weak, and skin irritancy is in some cases strong. Rubber adhesives excel in the initial tackiness, but have a problem that repeelable property markedly deteriorates as time elapses.

Further, the adhesive layer 30 for the wig formed with the adhesives of acrylic resins and rubber adhesives is not suitable for use because, when bonded to a scalp, it can not follow the movement of skin due to the hardness of the resin itself, the closeness of contact to the head deteriorates, and tends to peel, the adhesivity is weak to fix needle stitch portions 12A of hair materials 12 to the front portion 11*a*, and the adhesivity is weak between the adhesive layer 30 and the front portion 11*a* and peeling takes place easily.

Explanation is next made further in detail of the case to form the adhesive layer 30 using an adhesive for the wig of a urethane resin. As an adhesive for the wig of a urethane resin, the adhesive of a two liquid mixture type comprising a main agent and a solidifying agent can be preferably used. The main agent may be a polyol for a urethane resin as a main component and the solidifying agent may be polyisocyanate as a main component. Those are preferable in which two liquids are mixed and subject to gelation reaction, and generate a gel after completion of gelation reaction. The gelation can be accelerated by heating. Thereby, not only physical bonding force such as surface tension but also chemical bonding force is added by the action of isocyanate contained in the solidifying agent in the gelation process. Therefore, adhesivity excels between the artificial skin making up the front portion 11*a* and the adhesive layer 30, fixing force is markedly improved with the planted needle stitch portions 12A of hair materials 12, and fixing force of the same level as the hair fixing process with the conventional adhesives can be attained. The fixing force is defined as the adhesive force to needle stitch portions 12A of hair materials 12 planted to artificial skin of the adhesive layer 30 of the present invention, and is used to distinguish from the adhesive force by ordinary thermally activated adhesives.

Moreover, since an adhesive for the wig of a two liquid mixture type urethane resin becomes an adhesive layer of a gel structure after reaction, that is, a tackifying layer, it shows an excellent reaction to follow the movement of the head when the front portion 11*a* is located in a forehead portion, not causing deterioration of close contact to the scalp, and sufficient wig tackifying is realized.

Explanation is next made of a method to give fixing force with the front portion 11*a* to the needle stitch portions 12*a* of the planted hair material 12. The method can be carried out by mixing adhesives comprising monomers of two liquid mixture type urethane resins, coating on the front portion 11*a* the adhesive with a small amount of an organic solvent of the component of the front portion 11*a* added in the two liquids, and drying. As such organic solvents, if the material of the front portion 11*a* is a urethane elastomer, dimethylformamide (DMF) or Methylethylketone (MEK), or others may be used.

The strengths of fixing of the needle stitch portions 12A of hair materials 12 and tackifying force to the head of the adhesive layer 30 can be controlled by adjusting the mixing ratio of the main and the solidifying agents of the adhesive for the wig of the two liquid mixture type urethane resin, adjusting coating viscosity, and by adjusting the settling time after two liquids are mixed till coating on the front portion 11*a* with hair materials 12 planted thereon.

Figure 6:
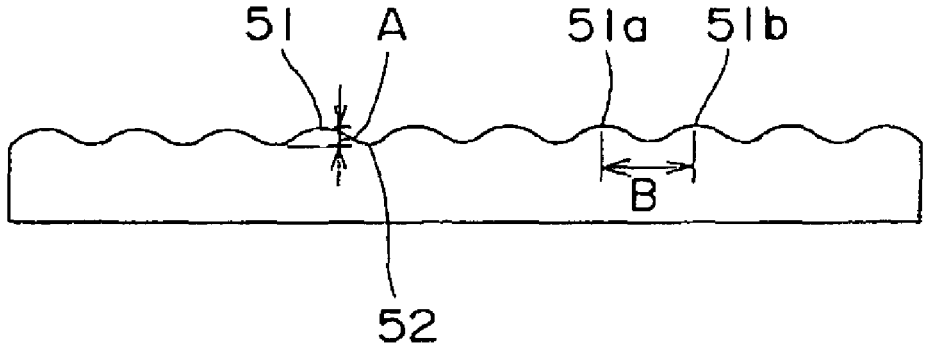
FIG. 6 is a diagrammatical view illustrating a shape processing of an outer edge of the front portion of the wig in accordance with an embodiment of the present invention.
Figure 7:
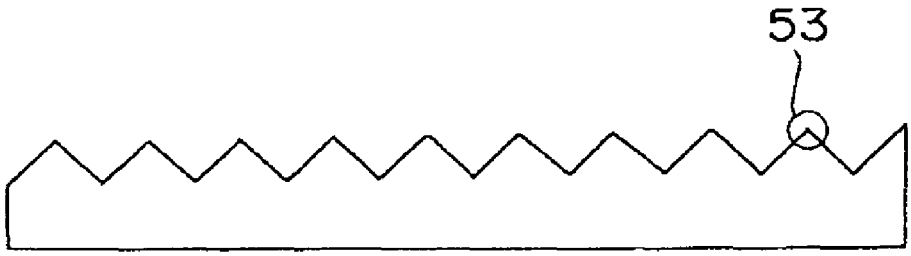
FIG. 7 is a diagrammatical view for comparison with the wavy shape shown in FIG. 6.
Figure 8:
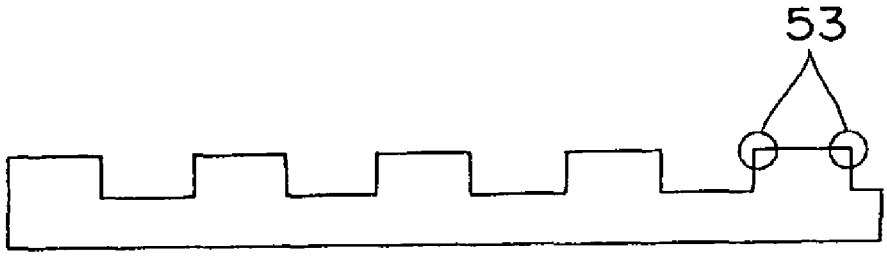
FIG. 8 is a diagrammatical view for comparison with the wavy shape shown in FIG. 6.

Further, the wig of the present embodiment has the front edge of the front portion 11*a* is formed in a wavy shape. FIG. 6 is a diagrammatical view illustrating a shape processing conducted to a front edge of the front portion 11*a*.

For the wavy shape in the figure, the top of a convex part with respect to the longitudinal direction is described as Top 51 and the valley bottom part between the hills on both sides is described as Valley 52.

FIG. 7-FIG. 12 are diagrammatical views for comparison with the wavy shape shown in FIG. 6. First of all, the reason why the front edge is made a wavy shape is, if the shape of the front edge is a polygonal such as a triangle, a square, or others as in FIGS. 7 and 8, the protruding part 53 of the front edge of the front portion 11*a* is curled up upon wig wearing, bringing the possibility of the wig exposure. Therefore, the shape of the front edge is suitably a wavy shape with its tip rounded.

Figure 9:
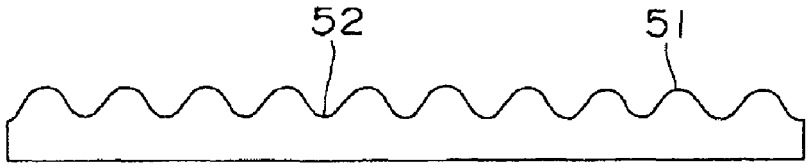
FIG. 9 is a diagrammatical view for comparison with the wavy shape shown in FIG. 6.
Figure 10:
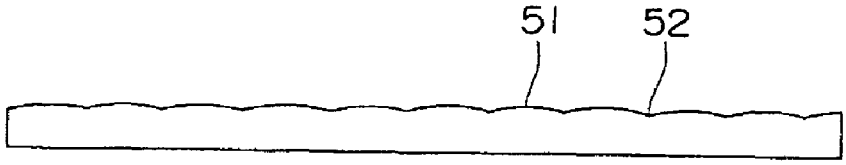
FIG. 10 is a diagrammatical view for comparison with the wavy shape shown in FIG. 6.

Also, as the size of the wavy shape, the length in the vertical direction against the longitudinal direction from the top 51 to the valley 52 in FIG. 6, that is, the depth A is preferably about 1.0 mm to 3.0 mm. If the depth is 3.0 mm or more as shown in FIG. 9, there is possibility of exposure upon wig wearing due to curling up of the tip including the top 51. Also if the depth A is 1.0 mm or less as shown in FIG. 10, almost no difference of the shape of the front edge is seen from the linearly processed outer edge of the front portion without wavy shaped front edge, and hence sufficient camouflaging effect can not be expected.

Figure 11:
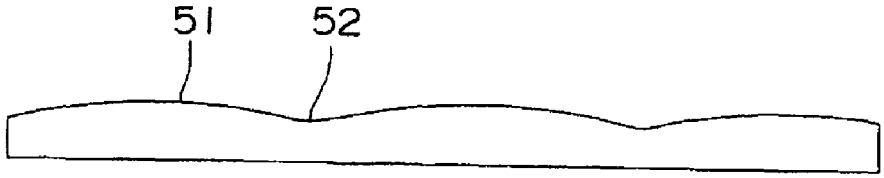
FIG. 11 is a diagrammatical view for comparison with the wavy shape shown in FIG. 6.
Figure 12:
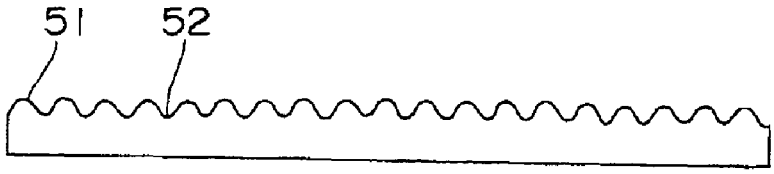
FIG. 12 is a diagrammatical view for comparison with the wavy shape shown in FIG. 6.

In FIG. 6, the length B in the longitudinal direction from the top 51*a* to the neighboring top 51*b* is preferably about 7.0 to 30.0 mm. If the length B of a wavy shape in the longitudinal direction is 30.0 mm or more, then, as shown in FIG. 11, there is no difference from the front edge shape processed linearly, and hence no camouflaging effect can be attained. If the length B of a wavy shape in the longitudinal direction is 7.0 mm or less, then the front edge shape is, as shown in FIG. 12, saw teeth-like, resulting in the shape wherein the peak-shaped parts including the top 51 protrude, and hence there is possibility that curl up may occur upon wearing.

The net pattern 11*b* connects to the front portion 11*a*, and has an identical or a similar shape to the wig wearer's head shape. The net pattern 11*b* is made of, for example, a material of different rigidity, thread diameter, and mesh from the shape retention net used as the base material of the front portion 11*a*, and is integrally combined with the front portion 11*a* by sewing, adhesion, or others at the connecting portion 11*c*. Hair materials 12 are attached to the net pattern 11*b* and the connecting portion 11*c* by the known methods of attaching hair materials, for example, by cow hitch or clove hitch. As a hair material 12, in addition to human hair, the artificial hair of, for example, an about 0.05 to 0.2 mm diameter made of nylon (registered trademark), polyester, or others is preferable. Further, on the wig 10, such a fixing member as the known stopper for a wig or an adhesive is provided to the desired position of the back side of the net pattern 11*b*, preferably in order to fix the wig 10 to the wearer's head.

The wig 10 of the embodiment of the present invention is constituted as described above.

Explanation is next made of a method of manufacturing the wig 10.

The method for manufacturing the artificial skin constituting a front portion is explained as a first step.

First of all, in FIG. 13(A), a shape retention net 23 of a flat synthetic resin is extended and contacted closely so no wrinkle is caused on a plaster pattern 22 of the male pattern 20 imitating the wearer's head shape. After that, as shown in FIG. 13(B), the shape retention net 23 is fixed by using fixing needle members 24*a* and 24*b* on the plaster pattern 22 of the male pattern 20.

Next, on the surface of the plaster pattern 22 of the male pattern 20 with the shape retention net 23 fixed thereon, a thermoplastic elastomer solution, for example, a solution of a urethane elastomer dissolved in DMF and MEK with a fungicide added therein is coated, and dried for about one hour at heating temperature 60° C.

Thereafter, a urethane elastomer solution of the urethane elastomer concentration lower by about 3% than the above-mentioned urethane elastomer solution is coated on the artificial skin, and similarly dried for about 30 minutes at the heating temperature 60° C. Thereby, the shape retention net 23 is covered with a urethane film over its whole net and meshes, and an artificial skin material of about 0.07 mm thickness, that is, the front portion 11*a* is formed. In this case, on the surface of the artificial skin material, deglossing effect is attained by forming a concave and convex lattice of the inner shape retention net 23, and, in order to further enhance the deglossing effect, powdery silica (average 3.1 to 4.2 μm) is added by about 8 weight % to the urethane elastomer solution as a deglossing agent, and a deglossing solution with a ultraviolet absorber and an antioxidant incorporated therein is further coated on the artificial skin material and dried for about 2 to 4 hours at heating temperature 60° C. Thus, the artificial skin material of about 0.09 to 0.11 mm thickness is formed by adding coating thickness of a deglossing solution by about 0.03 to 0.035 mm.

Figure 14:
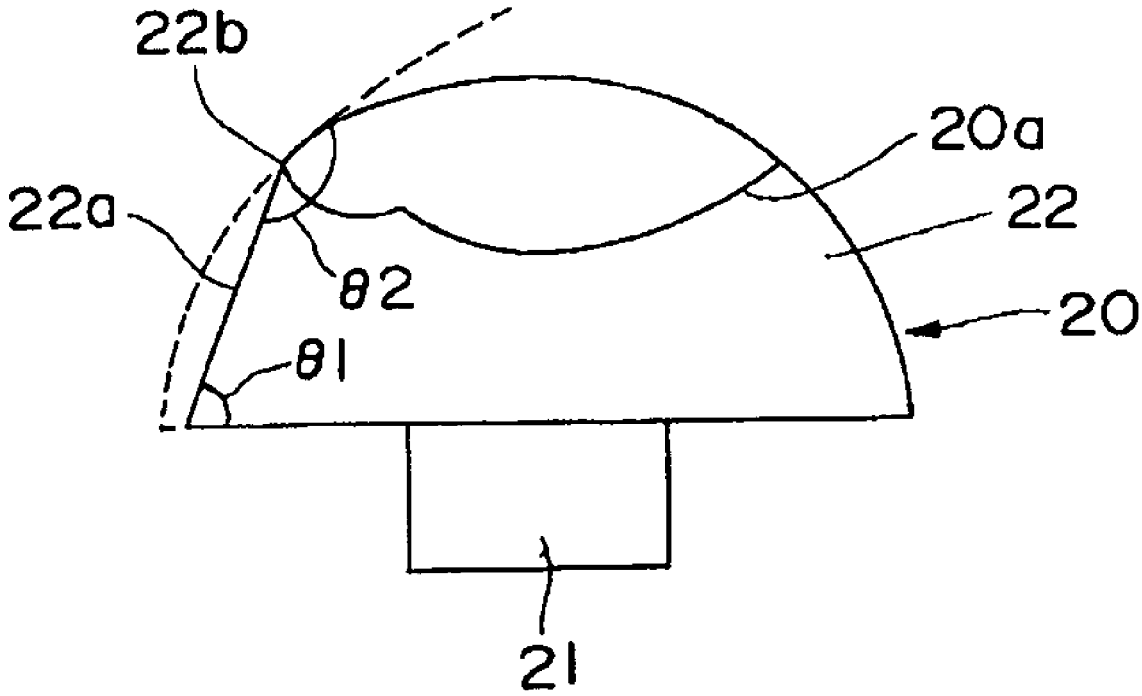
FIG. 14 is a diagrammatical side view illustrating a male pattern of a head shape for shaping the artificial skin of the wig of FIG. 1.

Making an artificial skin material in the above-mentioned first step is characterized to use such the male pattern 20 as described below. Concretely, the male pattern 20 of the wearer's head shape shown in FIG. 14 is used. The male pattern 20 is constituted with the plaster pattern 22 set on a stage 21, and several kinds of plaster patterns of typical head shapes may be prepared, and the pattern most closely approximating to the wearer's head shape may be chosen and used, but more preferably a plaster pattern strictly shaped of the individual wearer's head shape is used. On the surface of the male pattern, a border line 20*a* is drawn indicating the pre-set in advance regions of the front portion 11*a* and the net pattern 11*b*. Further, in the male pattern 20 of the present embodiment, the lower part is cut off from the position corresponding to a forehead portion of the border line 20*a* forming an outline of the wig base 11 compared with the wearer's head shape (shown by a dotted line).

Concretely, it has a cut off face 22*a* cut to a sharper inclination than the outline of the wearer's forehead portion from the upper end of the wearer's forehead portion corresponding to the virtual hairline to the lower side of the plaster pattern. The cut off face 22*a* is such that both the forehead hairline corner portions of the virtual hairline are cut off, while they have a pre-determined angle θ1 to a horizontal plane. The angle θ1 is chosen preferably as 75 to 90 degrees, the most preferably as 90 degrees. If the angle θ1 is less than 75 degrees, sufficient curl up prevention effect and/or sufficient warp up prevention effect can not be attained, and if it is the angle exceeding 90 degrees, though the warp up prevention effect can be attained, as the male pattern 20 is provided with an undercut, separation of artificial skin is not conducted smoothly, and it is difficult to cover the male pattern with a shape retention net as the base material so as not to generate wrinkles.

Figure 15:
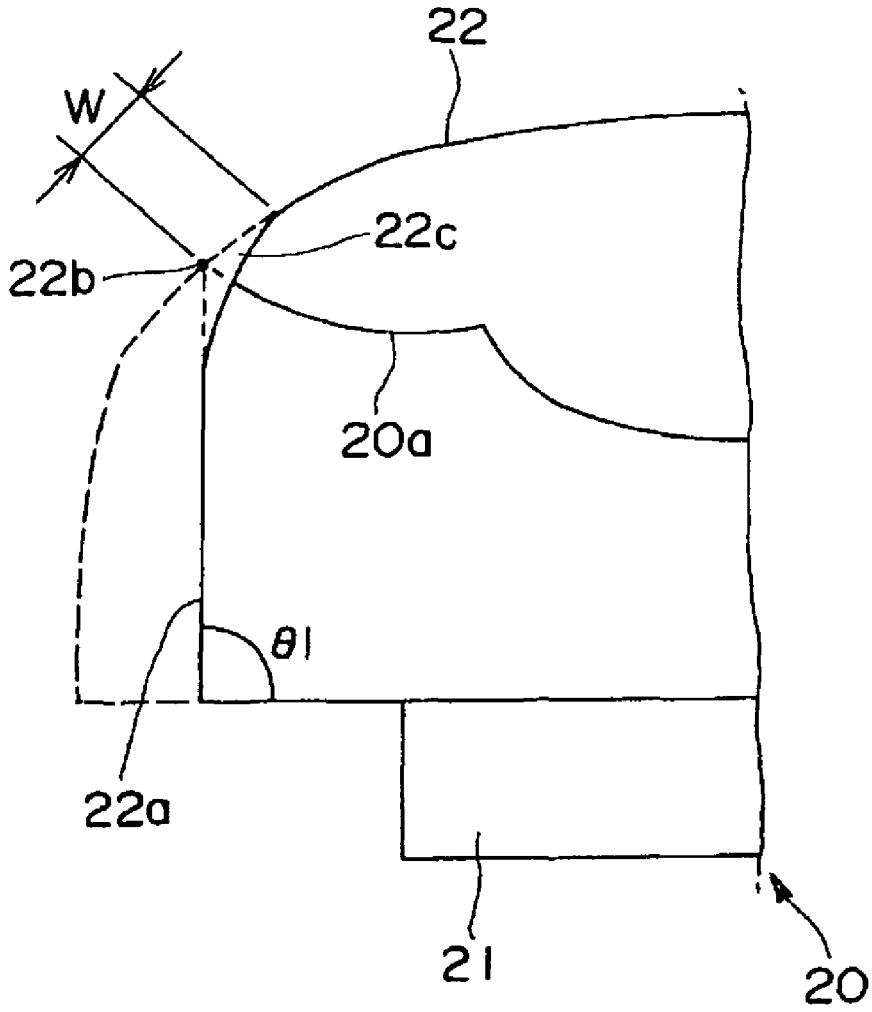
FIG. 15 is a partially enlarge view illustrating in details rounding of a ridge line of the head shape male pattern of FIG. 14.

A ridge line 22*b* is formed as a border between the thus formed cut off face 22*a* and the surface of the head shape of the plaster pattern 22, and the cut off face 22*a* has the pre-determined angle θ2 to the surface of the plaster pattern 22. For example, the ridge line 22*b* having an angle θ2 over 150 degrees is formed. In the present embodiment, the ridge line 22*b* is, as shown with the mark 22*c* in FIG. 15, preferably rounded by chamfering (edge cutting) by the pre-determined width w to the curved shape. The width of chamfer w is chosen preferably as 2 to 5 mm, the most preferably as 3 mm. If the width of chamfer w is less than 2 mm, the warp up prevention effect is not improved by rounding the ridge line 22*b*. If the width of chamfer w exceeds 5 mm, since the shape of the chamfered part largely differs from the head shape, close contact to the wearer's head deteriorates. By thus chamfering and curving the ridge line 22*b* of the plaster pattern 22 to a curved shape, a curve line which crosses from the left to the right between the front edge region 111 and the rear region 112 of the front portion 11*a* of the shaped wig base 11 disappears, and the part of the front portion 11*a* can be curved and formed arc-like.

When the wig base 11 is manufactured by using the male pattern 20, the plaster pattern 22 of the male pattern 20 is covered with the shape retention net 23, and especially after fixing the shape retention net 23 on the cut off face 22*a* so that wrinkles and sagging are not generated, a thermoplastic elastomer is coated and dried. Thereby, the artificial skin portion 110*a* constituted with artificial skin and a shape retention net integrated with the artificial skin can be formed.

Next, as second step, a net made of a synthetic resin is prepared, and a shape fitting to the wearer's head shape is set to the net, thereby the net pattern 11*b* to be a top portion is obtained. Concretely, in order to shape the net to the wearer's head shape, the net is put on the male pattern of the head shape, the net is processed with resin on the male pattern. The resin treatment is, after putting and fixing a net made of a polyamide fiber such as nylon (registered trademark) on the prepared male pattern of the wig wearer's head shape, coating a thermosetting urethane resin solution over the net, and shaping by drying at heating temperature 100° C. for 8 hours. Next is conducted ultrasonic processing after the net is peeled off from the male pattern. The ultrasonic processing is a treatment to melt-bond the crossing parts of the thread making up the net by ultrasonic wave and pressure, to fix the crossing parts. After ultrasonic processing is applied, the ultrasonic-processed net is put and fixed on the plaster pattern positioned from a forehead portion to a rear head portion, at left and right side head portions, then a thermosetting urethane resin solution is coated over it, and shaping is completed by drying at heating temperature 100° C. for 4 hours. In this example, since polyamide net was used as the net, ultrasonic processing and reshaping treatment processing were conducted after resin processing with a thermosetting urethane resin solution, but this is because polyamide resins have high water absorbency so that poor size stability as the result, and the shape formed to the head shape tends to deform, so that its object is to prevent the deformation. In the case of the nets other than polyamide fibers, there is no special problem only by resin processing with a thermosetting urethane resin solution since water absorbency is low and size stability is good. The net is preferably used that the thread diameter of the net used for shaping is about 220 D and the mesh is about 25 meshes (strands/inch), however the net used for shaping may be of a material capable of shaping of a head shape, and the numerical values of the thread diameter and the mesh may be appropriately changed.

Next as third step, on the artificial skin portion 110*a* manufactured in the first step, the net pattern 11*b* fitted to the wearer's head shape in advance by the second step is overlapped, and the artificial skin portion 110*a* and the net pattern 11*b* are combined for integration by sewing or bonding at the position of a connecting portion 11*c*.

As fourth step after the connection, the excess part of the artificial skin material to be the front portion 11*a* is cut off, and also the excess part of the net pattern to be the top portion is cut off to obtain the wig base 11 of the pre-determined shape. Concretely, as the excess part of the artificial skin material, the part behind the connection portion 11*c* is cut off, and as the excess part of the net pattern, the part before the connection portion 11*c* is cut off. Thereby, the basic shape of the wig base 11 wherein the front portion 11*a* and the net pattern 11*b* shown in FIG. 1 are zoned is formed. Upon this cutting, the wavy shape processing of the front edge 11*a*' of the front portion 11*a* provided at the wig forehead portion side is conducted. Thus, the wig base 11 is completed.

As a fifth step, hair materials 12 are attached over the whole surface of the wig base 11 by a known hair attaching method so as to attain the desired or the pre-determined hair amount and hair flow.

In sixth step, an adhesive layer 30 for a wig is formed on the back side of the front portion 11*a* where the hair materials are attached. The adhesive layer 30 can be formed by coating and drying the adhesive having the function to fix the needle stitch portion 12A of the hair materials 12, which are attached and coming out to the back side of the front portion 11*a*, and the function to bond to the head. As a coating method of the adhesive for a wig, such methods as spraying and brushing can be applied.

Explanation is made here of a detailed method for manufacturing of the adhesive layer 30.

First of all, the artificial skin material with the hair materials 12 attached is reversed and fixed to the male pattern of the wig wearer's head shape. The male pattern of the head shape is made, for example, of a thermosetting epoxy resin. A two liquid mixture type adhesive of a main agent of a polyol for a urethane resin as the main component and a solidifying agent of a polyisocyanate as the main component is mixed, and stirred. If necessary, proper amounts of DMF and/or MEK as organic solvents may be added.

Settling this solution at room temperature for the pre-determined time for the reaction to proceed, a solution of an adhesive for a wig is obtained. Settling for the pre-determined time is for a bridging reaction of the molecules in the mixed and stirred solution to proceed to some extent. The solution of an adhesive for a wig settled for the pre-determined time is coated with a brush on the back side of the artificial skin to the desired thickness, dried at the heating temperature higher than room temperature for the pre-determined time, cooled after drying to room temperature, thereby the adhesive layer for the wig 30 is formed.

In order to obtain the adhesive layer 30 of the desired thickness, coating and drying by heating of the solution of an adhesive for a wig may be repeated. Meanwhile, on the back side of an artificial skin portion where the adhesive layer 30 is not coated, an urethane solution for hair fixing is coated to fix the needle stitch portions 12A of the hair materials 12 to the artificial skin.

Example

Bending rigidity of the front portion 11*a* fixed to a shape retention net 23 was measured. As a Comparative Example, likewise the above-mentioned front portion 11*a*, the front portion comprising only the artificial skin not including the shape retention net 23 was manufactured. As the measurement of bending rigidity, the whole sample of the artificial skin was bent as the sample at constant speed to an arc shape to a certain curvature, a small bend momentum accompanying it was detected, and the relationship between this bend momentum and the curvature was measured. As the measuring conditions were Distance between Chucks: 1 cm, Torque Detector: Detection of Torque of Tortion Wire (Steel Wire), Torque Sensitivity: 1.0 gf·cm (at Full Scale 10V), Curvature: $\pm 2.5\ cm \times 10^{-1}$, Rate of Bend Deviation: $0.5\ cm \times 10^{-1}$/sec, Measurement Cycle: 1 Round Trip, Sample width: 1 cm, Sample film thickness: 100-110 μm for both with and without net, Temperature: 22° C., Humidity: 60% RH.

Figure 16:
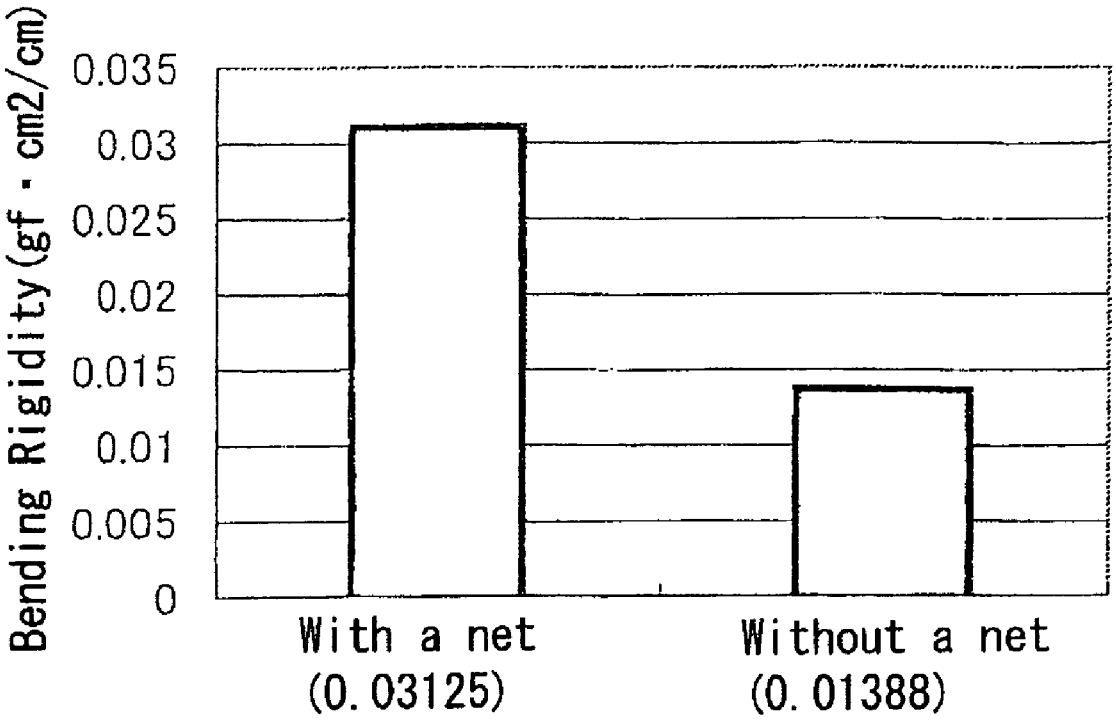
FIG. 16 is a graph for comparison of the bending rigidities of the artificial skin used for the wig of FIG. 1 and the artificial skin without a shape retention net.
Figure 17:
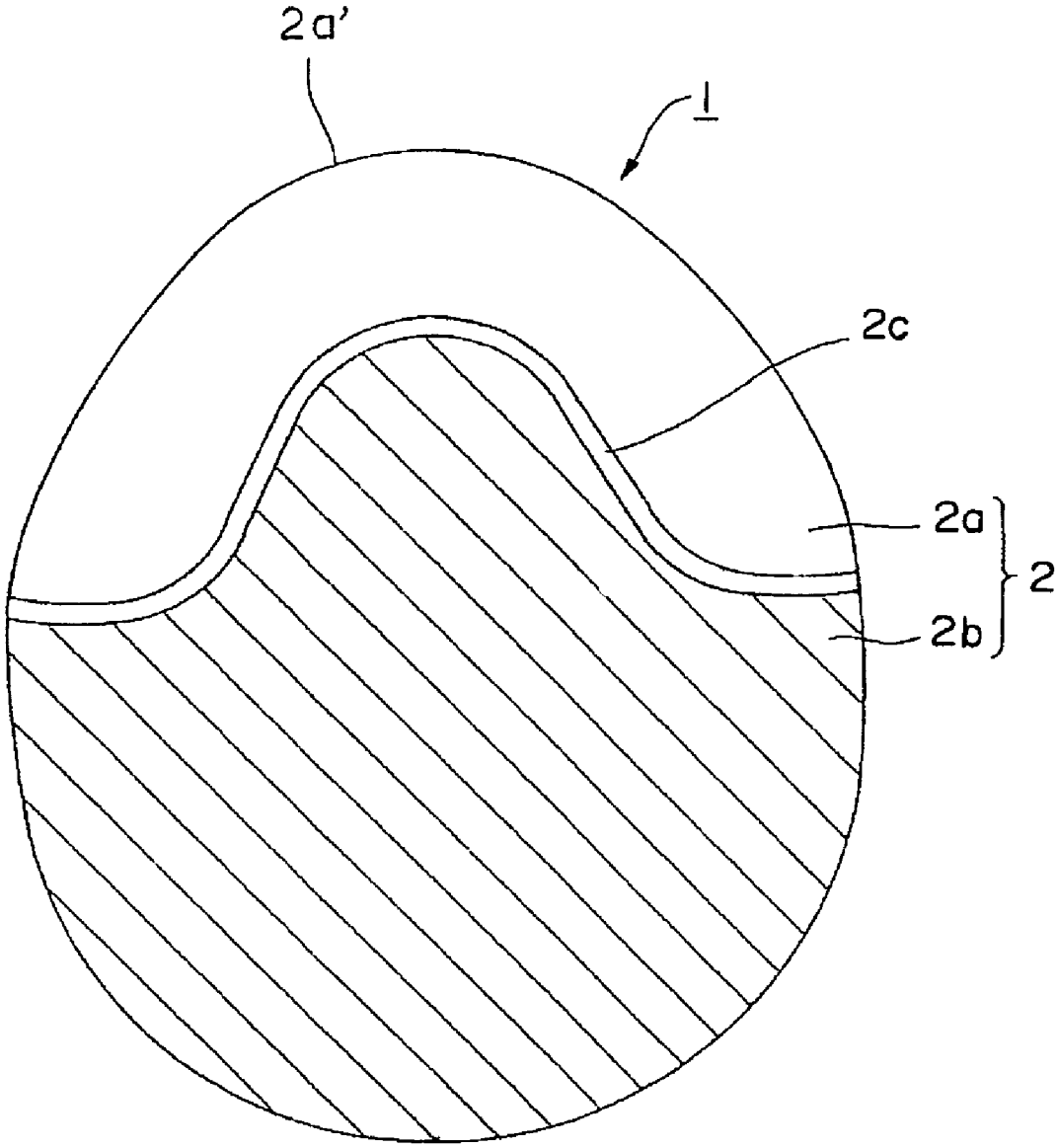
FIG. 17 is a plan view illustrating the back side of a makeup of one example of a conventional wig.
Figure 18:
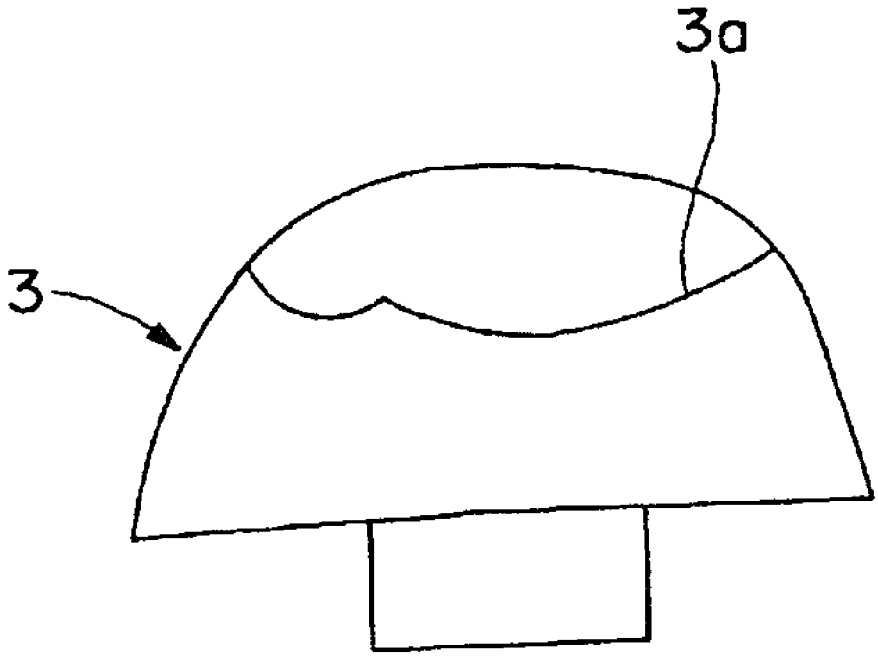
FIG. 18 is a diagrammatical side view illustrating a male pattern of a head shape for shaping the wig base of the wig of FIG. 17.

As the result of such measuring experiments, as shown in FIG. 16, the bending rigidity ($gf \cdot cm^2/cm$) with a net was 0.03215, which is seen to be higher than 0.01388 for the case without a net. The artificial skin with a net (shape retention net), that is, the front portion 11*a* of the present invention has high bending rigidity compared with the case without a net. The higher the bending rigidity, as resistance is higher to such a force applied from outside as bending and others, the harder are curl up or wrinkles generated, and also the harder is warp generated.

The wig 10 of the present invention has the warp up prevention structure 110 with a front edge region 111 of the front portion 11*a* of the wig base 11 bent to a sharper inclination than the corresponding wearer's head outline. The warp up prevention structure 110 is formed arc-shaped to give a curved ridge line at the bending position between the front edge region 111 having the pre-determined width from the front edge 11*a*' of the front portion 11*a* to inside and the rear region 112 connected thereto. This curved bending portion is formed by the faithfully copied curved shape of a chamfered portion 22*c* formed on the plaster male pattern 20. Therefore, upon wig wearing, the front portion 11*a* itself closely contacts to the wearer's forehead portion in a curved state as if biting in, as well as since the front portion 11*a* itself is formed in the state curved inside when the front edge of the front portion 11*a* is going to curl up by repeated use, it can be prevented that the front region of the front portion 11*a* warps and floats up so much so as not to fit to the wearer's head shape.

Further according to the present invention, since the front portion 11*a* constituting the forehead portion of the wig base 11 is formed by burying the shape retention net 23 as the base material into a urethane resin, rigidity and shape retain ability are enhanced by the shape retention net 23 compared with a ultra-thin front portion 11*a*, and generation of curl up or wrinkles of the front edge is prevented. Thereby, the wig base is worn in the more closely contacting state to the wearer's head, especially in the forehead region.

As described above, according to the present invention, the front portion 11*a* provided in the forward portion of the net pattern 11*b* is formed with the shape retention net as the base material, as well as the front edge is formed slightly curved inside compared with the head shape, such does not occur that warp is generated by curl up or wrinkles in the wig base 11, especially in the front portion 11*a*, by repeated use so that the wig base 11 floats up from the wearer's head. Therefore, since close contact of the wig base 11, especially of the front portion 11*a* to the wearer's head is maintained, appearance of the wig 10 does not deteriorate, and the use of the wig 10 is not exposed.

Further, since the wig 10 is provided with the adhesive layer 30 in the back side of the front portion 11*a*, for example, at the front edge side, floating up of the front portion 11*a* can be prevented as it contacts closely to the wearer's head by the adhesive layer 30. The adhesive layer 30 comprising a single layer may have the thickness so as to be capable of fixing needle stitch portions 12A of hair materials 12, and since if the diameter of attached hair materials 12 is, for example, 0.08 to 0.09 mm, then as thin as about 0.05 mm is enough for the thickness, the ultra-thin front portion 11*a* of the forehead portion can be made light-weighted. Also, the adhesive layer 30 at the side to be bonded to the head has re-peel ability, and can be used repeatedly as tackiness is recovered only by washing the adhesive layer portion with water or organic solvents. Therefore, the wig 10 of low cost can be realized, and the wearer's financial load can be low.

Further, the wig base 11 has the region corresponding to the wearer's forehead portion, that is, the front edge 11*a*' of the front portion 11*a* shaped wavy, so that, upon wig wearing, close contact of the front portion 11*a* to the wearer's forehead portion is improved, and the camouflaging effect at the hairline of the forehead is enhanced.

As described in detail above, the present invention can be implemented in various forms within the range of its essential scope. For example, when the adhesive layer 30 is coated at the front edge side of the back side of the front portion 11*a*, a plurality of the adhesive layers 30 may be coated scattered about at the pre-determined interval along the outline of the front edge of the front portion 11*a*, or may be coated over the whole back side of the front portion 11*a*. Formation of the adhesive layer 30 in the front portion 11*a* is not necessarily indispensable. Other bonding means, for example, a medical instant adhesive may be used for fixing.

The front portion 11*a* is not necessarily to be provided only in the whole region corresponding to the forehead portion, but may be provided, for example, only at the position corresponding to the wearer's parting portion.

In the above-mentioned embodiment, the front portion 11*a* was explained by the example of the shape retention net buried into artificial skin, but it may be constituted as well by laminating artificial skin and a shape retention net with either one of them above and the other below.

Also, in the example, a wave-shaped front edge was made only on the edge of the front portion 11*a*, but similar insections may be made in such an outer edge portion as the side and the rear head portions other than the forehead portion to give a camouflaging effect. For example, the outer edge of a net pattern 11*b* provided to the top portion may be made wavy. This wave-shaped insection is not necessarily essential to the constitution of the present invention.

Urethane gel was explained as the adhesive layer 30 comprising a monolayer, the kinds of adhesives can be arbitrarily chosen as far as it has fixing ability of the needle stitch portion 12A of the hair material 12 attached to the front portion 11*a* and re-peel ability from a scalp. A deglossing agent may be not limited to silica but any other deglossing agents. Further, concrete numerical values explained in the above-mentioned embodiment may be properly changed upon necessity.

In the present embodiment, an example was shown in which a front and a top portions were zoned, and the top portion was formed with a net pattern, but needless to say that the whole wig base may be made of the artificial skin similar to the front portion.

Industrial Applicability

It will be appreciated from the foregoing description that according to the present invention, since the front portion is formed with the ultra thin artificial skin material integrated with the shape retention net, and the front edge region is formed slightly curved toward the head portion with respect to the head shape, curl up, wrinkles, and stretch are not generated in the wig base, especially in its front portion, even by repeated use, so that it does not float up from the wearer's head. Consequently, since close contact of the wig base, especially of its front portion, with the wearer's scalp is maintained, appearance of the wig does not deteriorate, and use of the wig is not exposed.

What is claimed is:

1. A wig provided with a wig base and hair materials attached to the wig base, characterized in that:

the wig base is provided with an artificial skin portion at least in a front portion from a virtual hairline of a wearer's forehead portion toward a top portion, the artificial skin portion is made of a synthetic resin film integrated with a shape retention net, and is provided with a front edge region of a pre-determined width from a front edge positioned on the wearer's virtual hairline toward inside and a rear region connected to the front edge region, and the front edge region includes a warp up prevention structure which is bent to inclination sharper than a wearer's corresponding head outline.

2. The wig as set forth in claim 1, characterized in that:

the wig base includes the front portion constituted with the artificial skin portion and the top portion connected to the front portion, the top portion is constituted with a net pattern, and the rear region excluding the front edge region of said front portion and the top portion are formed in a curved shape substantially corresponding to a wearer's head shape.

3. The wig as set forth in claim 1, characterized in that:

the warp up prevention structure is shaped arc-like to form a curved ridge line at a bent position between the front edge region and the rear region connected thereto.

4. The wig as set forth in claim 1, characterized in that:

the front edge region of the warp up prevention structure is curved arc-like in a width direction.

5. The wig as set forth in claim 1 or 2, characterized in that:

the shape retention net of the front portion is made of a non-elastic net.

6. The wig as set forth in claim 1 or 2, characterized in that:

the front edge of the artificial skin portion is formed in a wavy shape, and is located at a position of the wearer's virtual hairline.

7. The wig as set forth in claim 1 or 2, characterized in that:

a thickness of the artificial skin portion is between 0.08 mm and 0.12 mm.

8. The wig as set forth in claim 1 or 2, characterized in that:

the artificial skin portion is provided with an adhesive layer adhered unpeelably to an back side of the artificial skin portion, having a function to fix needle stitch portions of the hair materials attached to the artificial skin portion, and to be pressure-bonded repeelably to head skin.

9. The wig as set forth in claim 8, characterized in that:

a repeelable function of the adhesive layer is realized after completion of gelation reaction of the adhesive layer.

10. The wig as set forth in claim 8, characterized in that:

the adhesive layer is made of urethane gel.

11. The wig as set forth in claim 10, characterized in that:

the urethane gel is made of a urethane resin pressure-sensitive adhesive of a two liquid mixture type comprising a main agent and a solidifying agent, wherein the main agent is a polyol with a urethane resin as a main component and the solidifying agent is polyisocyanate as a main component.

* * * * *